US010782001B2

(12) United States Patent
McCane et al.

(10) Patent No.: US 10,782,001 B2
(45) Date of Patent: Sep. 22, 2020

(54) LIGHT ENGINE RETROFIT KIT FOR EXISTING LIGHT FIXTURES AND ASSOCIATED METHOD

(71) Applicant: ABL IP Holding LLC, Atlanta, GA (US)

(72) Inventors: Stephen Barry McCane, McDonough, GA (US); Albert Tran, Lawrenceville, GA (US); Denise Bonsell, Grayson, GA (US)

(73) Assignee: ABL IP Holding LLC, Atlanta, GA (US)

( * ) Notice: Subject to any disclaimer, the term of this patent is extended or adjusted under 35 U.S.C. 154(b) by 238 days.

(21) Appl. No.: 15/958,223

(22) Filed: Apr. 20, 2018

(65) Prior Publication Data

US 2018/0306417 A1 Oct. 25, 2018

Related U.S. Application Data

(60) Provisional application No. 62/488,221, filed on Apr. 21, 2017.

(51) Int. Cl.

| | |
|---|---|
| ***F21V 17/16*** | (2006.01) |
| ***F21K 9/90*** | (2016.01) |
| ***F21V 17/10*** | (2006.01) |
| ***F21K 9/275*** | (2016.01) |
| ***F21V 9/00*** | (2018.01) |
| ***F21S 8/04*** | (2006.01) |
| ***F21V 21/04*** | (2006.01) |
| ***F21Y 115/10*** | (2016.01) |
| ***F21Y 103/10*** | (2016.01) |
| ***F21V 19/00*** | (2006.01) |

(52) U.S. Cl.

CPC ..... *F21V 17/164* (2013.01); *F21K 9/275* (2016.08); *F21K 9/90* (2013.01); *F21S 8/043* (2013.01); *F21V 17/108* (2013.01); *F21V 19/0045* (2013.01); *F21V 21/04* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 10,041,654 | B1 * | 8/2018 | Ernst et al. | F21V 7/00 |
| 10,094,519 | B1 * | 10/2018 | Stranczek et al. | F21K 9/275 |
| 10,180,217 | B2 * | 1/2019 | Vang et al. | F21K 99/00 |
| 10,247,373 | B1 * | 4/2019 | Ladewig et al. | F21S 8/04 |
| 2004/0020137 | A1 * | 2/2004 | Battey et al. | E04B 2/74 |
| 2010/0053947 | A1 * | 3/2010 | Fowler, Jr. et al. | F21S 4/00 |
| 2015/0267873 | A1 * | 9/2015 | Price et al. | F21K 99/00 |

* cited by examiner

*Primary Examiner* — Britt D Hanley

(74) *Attorney, Agent, or Firm* — Kilpatrick Townsend & Stockton LLP

(57) ABSTRACT

A retrofit kit for a light fixture includes a light engine and a mounting bracket. In some aspects, a method of installing the retrofit kit in a light fixture includes installing a mounting bracket in a housing of the light fixture, and placing a light engine in a temporary hanging position. In the temporary hanging position, a hook of a first engine flange of the light engine rests on the mounting bracket and a second engine flange of the light engine opposite from the first engine flange is spaced apart from the mounting bracket.

20 Claims, 19 Drawing Sheets

LIGHT ENGINE RETROFIT KIT FOR EXISTING LIGHT FIXTURES AND ASSOCIATED METHOD

REFERENCE TO RELATED APPLICATIONS

This application claims the benefit of U.S. Provisional Application No. 62/488,221, filed on Apr. 21, 2017, and entitled LIGHT ENGINE RETROFIT KIT FOR EXISTING LIGHT FIXTURES AND ASSOCIATED METHOD, the content of which is hereby incorporated by reference in its entirety.

FIELD OF THE INVENTION

Embodiments of the invention relate to light fixtures, and more particularly to light emitting diode (LED) based light sources for use in existing fluorescent light fixtures.

BACKGROUND

Traditional light fixtures presently used in a typical office environment comprise a housing with at least one fluorescent lamp and a lens having prismatic elements for distributing the light. Historically, the most commonly used fluorescent lamps in indoor lighting applications have been the linear T5 (⅝ inch diameter), T8 (1 inch diameter), and the T12 (1½ inch diameter). Such bulbs are inefficient and have a relatively short lamp life. Thus, efforts have been made to identify suitable alternative illumination sources for indoor lighting applications. Light emitting diodes ("LEDs") have been identified as one alternative to traditional fluorescent bulbs.

A LED typically includes a diode mounted onto a die or chip, where the diode is surrounded by an encapsulant. However, in comparison to simply changing a light bulb in a conventional light fixture, exchanging an existing fluorescent fixture for a light fixture that uses LEDs as a light source can be labor intensive and costly. Such replacement typically requires access to the area above the ceiling. Environmental concerns, such as asbestos contamination and asbestos removal, become an issue when disturbing the ceiling. Moreover, the area above the ceiling collects dirt and dust, which can dislodge during LED replacement and thereby increase the time and cost of clean-up after installation. Additionally, exposed electrical wiring is common in such areas, which creates a safety hazard for workers removing old fixtures. A licensed electrician may be required to install the new fixtures based upon common safety codes. Thus, businesses and consumers are reticent to invest in a new LED light fixture when the effort and costs are compared to maintaining an existing fluorescent light fixture.

Efforts have also been made to retrofit an existing fluorescent light fixture with a LED light source. However, existing fluorescent light fixtures may come in any number of different sizes and configurations. Specifically, LED retrofit kits may not be generally compatible with existing fluorescent light fixtures. Oftentimes, a given LED retrofit kit may only be compatible with existing light fixtures that share a common mounting arrangement. Even if the LED retrofit kit is compatible, it may be difficult to install, particularly for a single worker. Therefore, there exists a need for a LED retrofit kit that is generally compatible with existing light fixtures, and that may be easily installed by a single worker.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to various examples, a retrofit kit for a light fixture includes a light engine and a mounting bracket. In some examples, the light engine includes a base, a first engine flange at a first side of the base, and a second engine flange at a second side of the base opposite the first side. In certain cases, the first engine flange includes a foldable convenience tab, the second engine flange includes a hook, and the hook is configured to engage the mounting bracket such that the light engine is pivotally supported on the mounting bracket.

In various examples, the light engine is movable relative to the mounting bracket between a temporary hanging position, a temporary support position, and a fully-installed position. In some cases, in the temporary hanging position, the hook is engaged with the mounting bracket and the first engine flange is spaced apart from the mounting bracket. In various aspects, in the temporary support position, the hook is engaged with the mounting bracket, the foldable convenience tab is engaged with the mounting bracket, and the base of the light engine is spaced apart from a base of the mounting bracket. In certain examples, in the fully-installed position, the hook and foldable convenience tab are spaced apart from the mounting bracket, and the base of the light engine abuts the base of the mounting bracket.

In some aspects, the mounting bracket includes a bracket base, a first bracket flange at a first side of the bracket base, and a second bracket flange at a second side of the bracket base opposite the first side. According to various cases, the foldable convenience tab is configured to selectively engage the first bracket flange and the hook, and, in the fully-installed position, the first engine flange conceals the first bracket flange and the second engine flange conceals the second bracket flange. In certain aspects, the mounting bracket further includes a first mounting flange and a second mounting flange that are configured to support the mounting bracket on a housing of a light fixture.

According to some embodiments, the mounting bracket includes a first bracket flange and a second bracket flange, the hook is configured to engage the second bracket flange, and the foldable convenience tab is configured to engage the first bracket flange in a temporary support position such that the light engine is supported by the mounting bracket. In various examples, the hook includes a notch, and the second bracket flange includes a stopping tab that is configured to engage the notch in the temporary support position. In some cases, the light engine further comprises a plurality of light emitting diodes.

According to some examples, a method of installing a retrofit kit in a light fixture includes installing a mounting bracket onto a housing of the light fixture and placing a light engine in a temporary hanging position. In various cases, in the temporary hanging position, a hook of a first engine flange of the light engine rests on the mounting bracket and a foldable convenience tab of a second engine flange of the light engine is spaced apart from the mounting bracket. In various cases, placing the light engine in the temporary hanging position includes positioning a stopping tab of a first bracket flange of the mounting bracket in a notch defined by the hook.

In certain cases, the method includes pivoting the light engine relative to the mounting bracket such that the light engine is in a temporary support position. In various examples, in the temporary support position, the hook is engaged with the mounting bracket, the foldable convenience tab is engaged with the mounting bracket, and the light engine is vertically movable relative to the mounting bracket. In some aspects, in the temporary support position, the hook is engaged with a first bracket flange of the mounting bracket and the foldable convenience tab is bent and engaged with a second bracket flange of the mounting bracket. In various cases, in the temporary support position, a light engine base of the light engine is spaced apart from a bracket base of the mounting bracket such that a gap is between the light engine and the mounting bracket.

According to various examples, the method further includes positioning the light engine in a fully-installed position by securing the light engine to the mounting bracket. In some aspects, in the fully-installed position, a light engine base of the light engine abuts a bracket base of the mounting bracket.

According to certain examples, a retrofit kit for a light fixture includes a light engine and a mounting bracket. In certain cases, the mounting bracket includes a pair of bracket flanges at opposing sides of a bracket base and a pair of mounting flanges between the bracket flanges such that a distance between the mounting flanges is less than a distance between the bracket flanges. In some cases, the light engine is supportable on the bracket flanges in a temporary support position, and the mounting flanges are configured to engage a housing of the light fixture such that the mounting bracket is secured to the housing.

In various examples, the light engine includes a pair of engine brackets, where a first engine bracket of the pair of engine brackets includes a hook and a second engine bracket of the pair of engine brackets includes a foldable convenience tab. In some cases, in the temporary support position, the hook is engaged with a first bracket flange of the pair of bracket flanges and the foldable convenience tab is engaged with a second bracket flange of the pair of bracket flanges. According to various aspects, the light engine is movable relative to the mounting bracket from the temporary support position to a fully-installed position, and, in the fully-installed position, the hook is spaced apart from the first bracket flange and the foldable convenience tab is spaced apart from the second bracket flange.

In certain cases, the light engine is movable relative to the mounting bracket between a temporary hanging position, the temporary support position, and a fully-installed position. In some aspects, in the temporary hanging position, the hook is engaged with the first bracket flange of the mounting bracket and the second engine flange is spaced apart from the second bracket flange. In various cases, in the temporary support position, a base of the light engine is spaced apart from the base of the mounting bracket. In some examples, in the fully-installed position, the hook and foldable convenience tab are spaced apart from the bracket flanges, and the base of the light engine abuts the base of the mounting bracket. According to various aspects, the mounting bracket further includes channel-centering slots configured to receive portions of the housing of the light fixture during installation to position the mounting bracket relative to the housing. In certain examples, the retrofit kit includes a plurality of light emitting diodes on a light-emitting side of the light engine and a lens secured to the light-emitting side of the light engine below the plurality of light emitting diodes. In certain examples, the mounting flanges are bendable relative to the bracket base such that the distance between the mounting flanges is adjustable.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references are intended to refer to the orientation as illustrated and described in the figure (or figures) to which the components and directions are referencing.

Traditional light fixtures presently used in a typical office environment comprise a housing and a lens having prismatic elements for distributing the light. Typical light fixtures may also use parabolic reflectors to provide a desired light distribution. A description of such a light fixture may be found in U.S. Pat. No. 7,229,192, the content of which is hereby incorporated by reference.

A LED typically includes a diode mounted onto a die or chip, where the diode is surrounded by an encapsulant. The die is connected to a power source, which, in turn, transmits power to the diode. A LED used for lighting or illumination converts electrical energy to light in a manner that results in very little radiant energy outside the visible spectrum. LEDs are extremely efficient, and their efficiency is rapidly improving. For example, the lumen output obtained by 20 LEDs may soon be obtained by 10 LEDs.

Embodiments of the present invention relate to a retrofit kit for retrofitting existing light fixtures containing fluorescent or other light sources with light emitting diode ("LED") based light sources. Some embodiments of the retrofit kit include a light engine, a mounting bracket, and an optional lens. The retrofit kits disclosed herein may be installed in fixture housings of any dimensions, including but not limited to 1×4, 1×8, 2×4, etc. In some examples, a retrofit kit may be configured to accommodate a light fixture having specific dimensions, or it may be provided in a size that generally will fit within most generic existing light fixtures (e.g., it will universally fit with existing light fixtures). In some embodiments, a single retrofit kit is provided in a light fixture. However, it will be appreciated that multiple retrofit kits may be installed in a light fixture.

Figure 1:
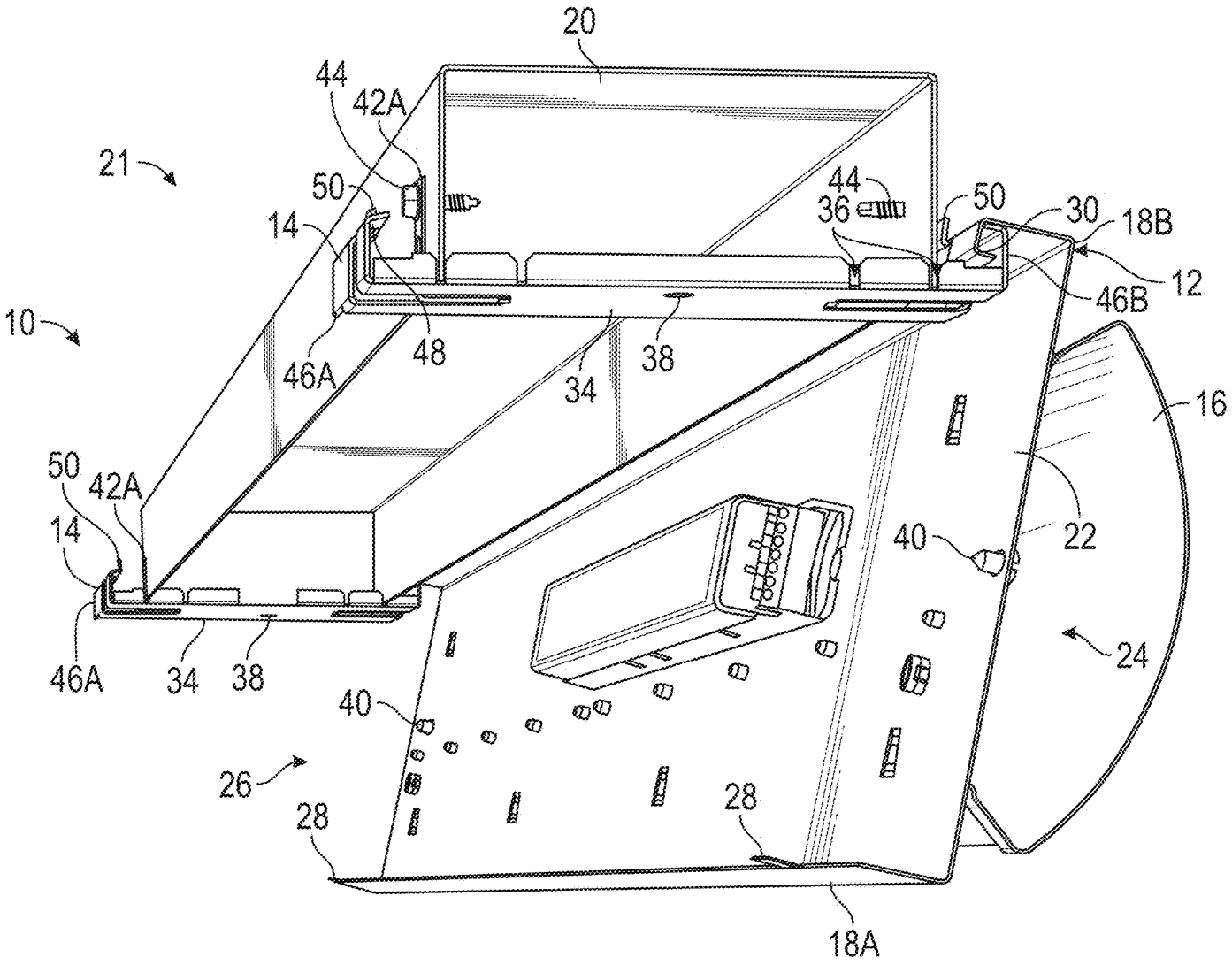
FIG. 1 is a perspective view of a light engine with a mounting system for retrofitting an existing light fixture according to examples of the present invention.
Figure 2:
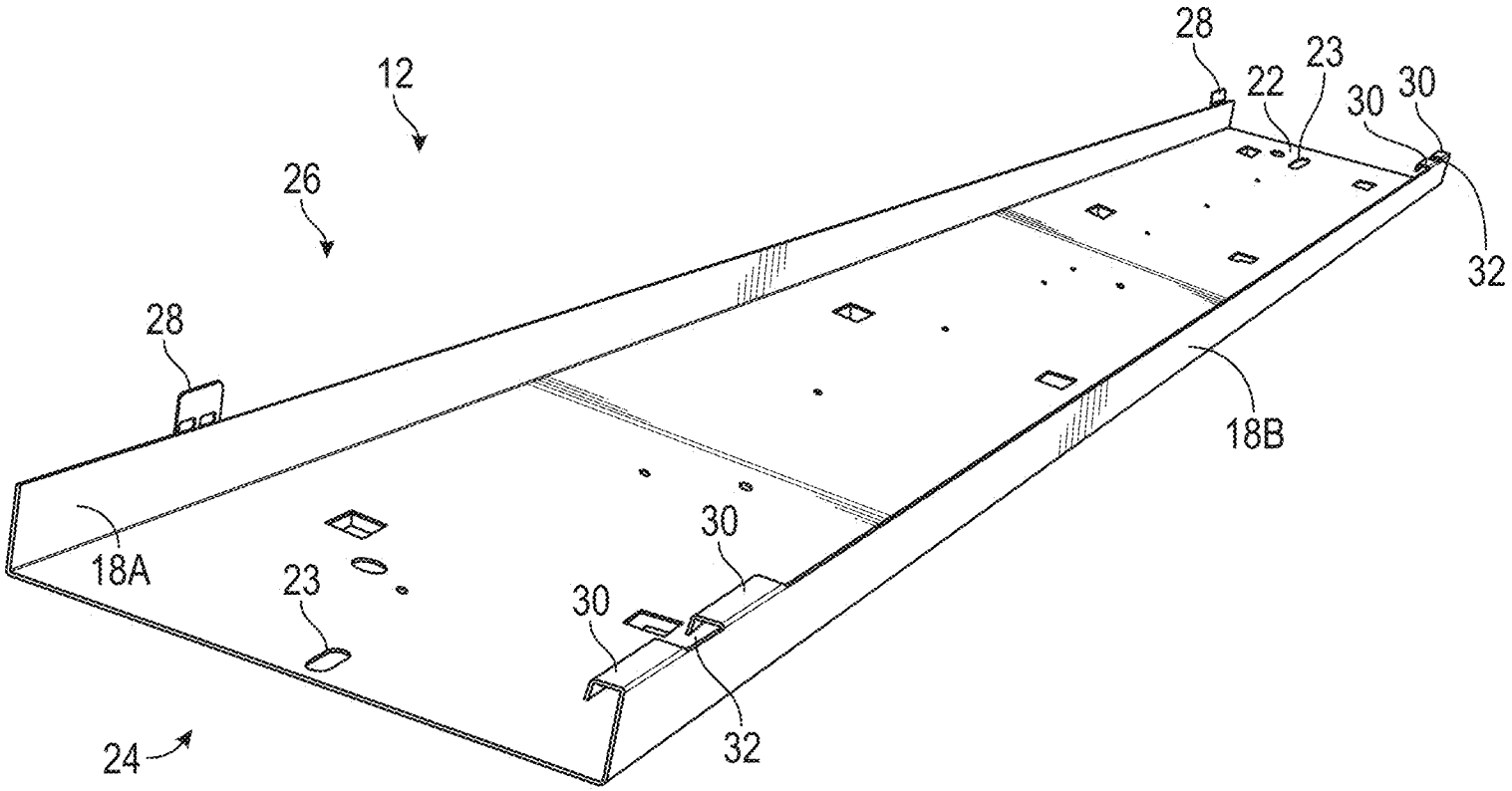
FIG. 2 is a perspective view of the light engine base of FIG. 1.
Figure 3:
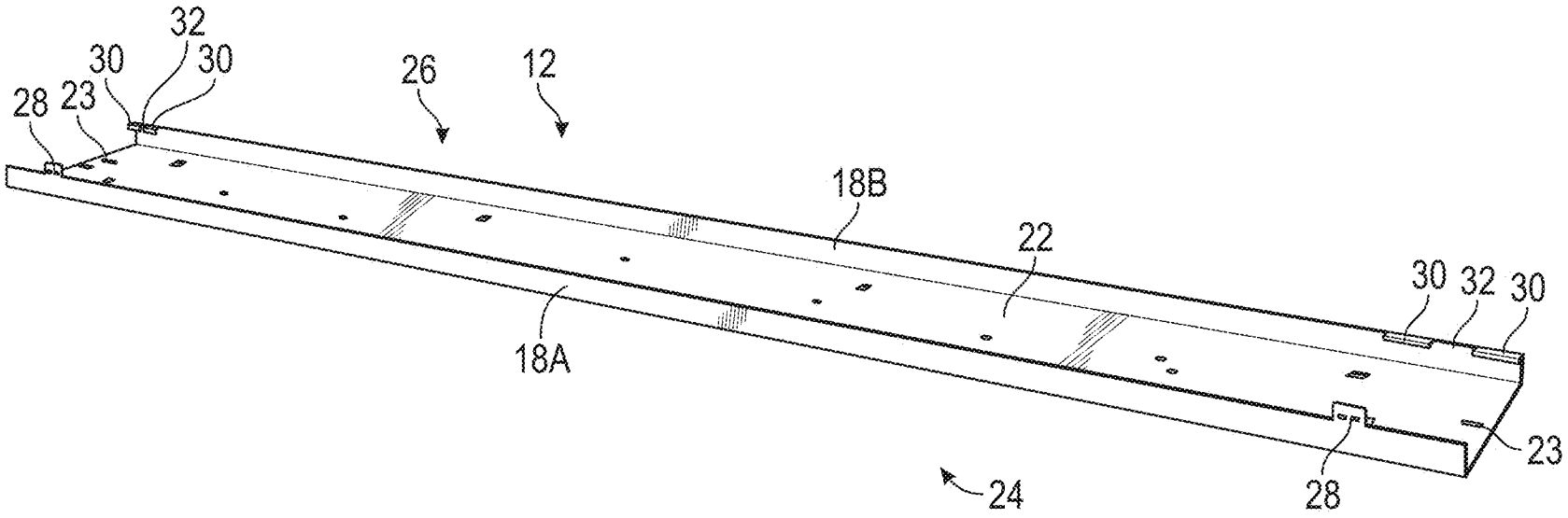
FIG. 3 is another perspective view of the light engine base of FIG. 1.

FIGS. 1-8 and 15-17 illustrate an example of a retrofit kit 10 that includes a light engine 12, a mounting bracket 14, and a lens 16. As shown in FIGS. 1-3, the light engine 12 includes a light engine base 22 having a light-emitting side 24 and a non-light-emitting side 26. At least one printed circuit board ("PCB") 52 (see FIG. 14) populated with a plurality of LEDs 53 (see FIG. 14) is mounted on the light-emitting side 24 of the light engine base 22. Each PCB can have wiring for connecting to a power supply, which can be shared between PCBs or each PCB could have its own power supply. The LEDs may be single-die or multi-die LEDs, DC, or AC, or can be organic light emitting diodes. White, color, or multicolor LEDs may be used. Moreover, the LEDs mounted on a PCB need not all be the same color; rather, mixtures of LEDs may be used. Furthermore, in some embodiments no PCB is needed; rather, the LEDs are chip-on-board LEDs. In some embodiments, no PCB is needed; rather, the LEDs are chip-on-board LEDs provided directly on the light engine base 22. In some examples, the light engine base 22 optionally defines at least one captive screw aperture 23 that accommodates a captive screw 40.

The light engine base 22 further includes engine flanges 18A-B. The engine flanges 18A-B extend away from the light-emitting side 24 of the light engine base 22. In some examples, the engine flanges 18A-B are integrally formed with the light engine base 22, although they need not be.

In some examples, the engine flange 18A includes a convenience tab 28. The convenience tab 28 is foldable relative to the engine flange 18A to aid in retaining the light engine 12 in a temporary support position (see FIG. 7). The number of convenience tabs 28 or location of the convenience tabs 28 along the engine flange 18A should not be considered limiting on the current disclosure. In some examples, the number and location of the convenience tabs 28 corresponds with a number and location of the mounting brackets 14, although they need not. In the example illustrated in FIGS. 1-8, the engine flange 18A includes two convenience tabs 28.

In various examples, the engine flange 18B includes at least one hook 30. In some examples, the hook 30 is at a position opposite a convenience tab 28, although it need not be. The number of hooks 30 or the location of the hooks 30 should not be considered limiting on the current disclosure. For example, in some cases, a plurality of hooks 30 or a single hook 30 may be provided at discrete locations along the engine flange 18B. In some examples, the number of hooks 30 corresponds with the number of convenience tabs 28, although they need not. For example, in various cases, a single hook 30 may be formed along a length of the engine flange 18B (see FIGS. 10 and 11). In the embodiment of FIGS. 2 and 3, a set of hooks 30 is provided on the engine flange 18B proximate each end of the light engine 12. Each set of hooks 30 defines a notch 32. The notch 32 is configured to receive portions of the mounting bracket 14 to aid in retaining the light engine 12 on the mounting bracket 14, as described below.

The retrofit kit 10 includes at least one mounting bracket 14. The number or location of the mounting brackets 14 should not be considered limiting on the present disclosure. In the example illustrated in FIG. 1, the retrofit kit 10 includes two mounting brackets 14.

Figure 4:
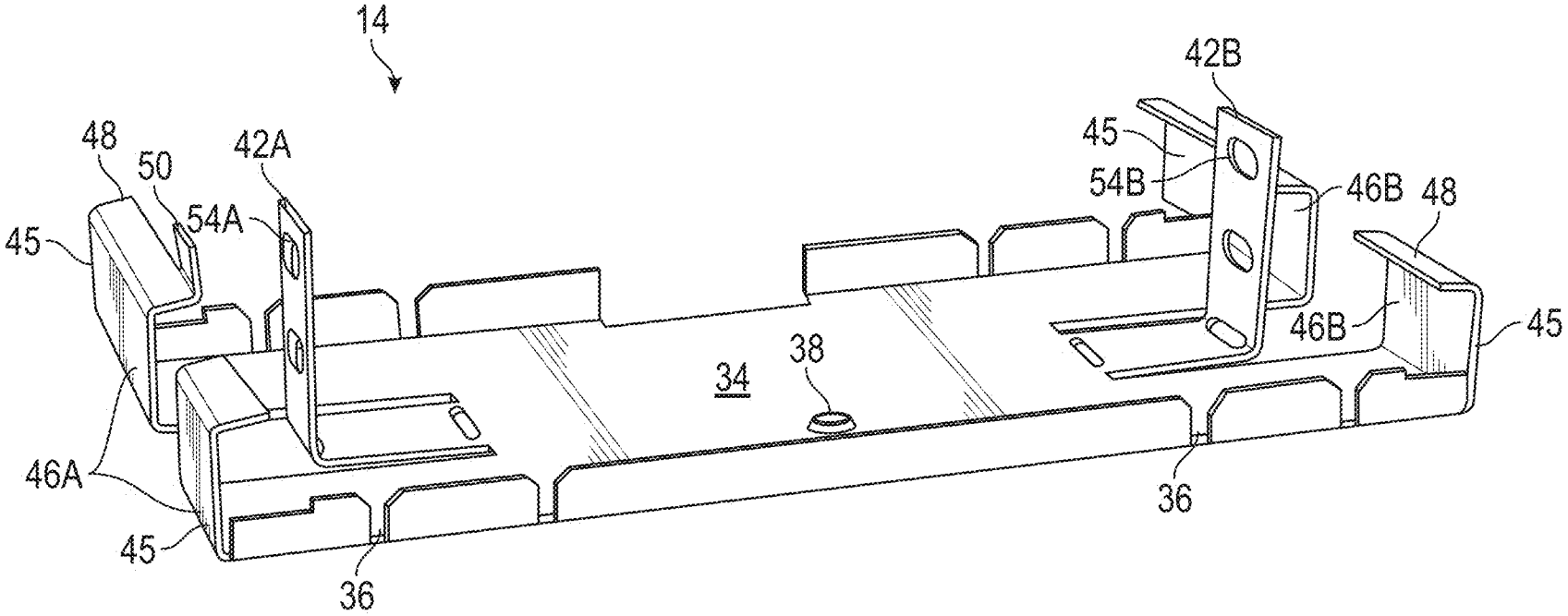
FIG. 4 is a perspective view of a mounting bracket of the mounting system of FIG. 1.

As illustrated in FIG. 4, the mounting bracket 14 includes a base 34. In some examples, the base 34 defines channel-centering slots 36 that receive portions of the housing 20 of the light fixture 21 during installation to position the mounting bracket 14 relative to the housing 20. The number and location of the channel-centering slots 36 may be varied as desired such that the mounting bracket 14 can accommodate a housing 20 having a particular dimension or can accommodate a plurality of housing dimensions. The base 34 further defines a captive screw aperture 38 that receives a captive screw 40 during installation to secure and position the light engine 12 relative to the mounting bracket 14.

Mounting flanges 42A-B extend from the base 34. Each mounting flange 42A-B defines a fastening aperture 54A-B (see FIG. 4) that receives a fastener 44 to secure the mounting bracket 14 relative to the housing 20. In certain examples, each mounting flange 42A-B is foldable or bendable relative to the base 32 such that the mounting flanges 42A-B can accommodate housings having different dimensions. In various examples, each mounting flange 42A-B is foldable where the mounting flanges 42A-B respectively extend from the base 34. Additionally or alternatively, the each mounting flange 42A-B may be foldable or bendable along a length of the flange. The fastener 44 may be various fasteners such as screws, bolts, pins, self-tapping screws, rivets, or various other suitable fasteners. In some examples, the fastener 44 is a self-drilling screw.

The mounting bracket 14 further includes a set of bracket flanges 46A-B extending from each side of the base 34. In some examples, the bracket flanges 46A-B include upstanding arms 45 and extensions 48 that extend inwardly at non-zero angles from the upstanding arms 45. In various examples, a stopping tab 50 extends at a non-zero angle from at least one extension 48 of each set of bracket flanges 46A-B. The stopping tabs 50 are configured to be received within the notches 32 defined by the hooks 30 of the light engine 12. The stopping tabs 50 may be provided to aid in retaining the light engine 12 in a temporary support position. In some examples, the stopping tabs 50 of the mounting bracket 14 are positionable between hooks 30 of the light engine 12. In various aspects, such positioning of the stopping tabs 50 restricts longitudinal translation of the light engine 12 during temporary installation (or at a temporary position during installation), which makes the light engine 12 more secure for the installer. In some optional examples, the convenience tabs 28 may be folded by the installer to rest on the extensions 48 and provide a temporary installation position until the installer secures the light engine 12 with fasteners 44. In some examples, the mounting bracket 14 may be symmetrical to allow for installation of the light engine 12 in 0° or 180° orientations. As one non-limiting examples, both sides of the mounting bracket 14 may include extensions 48 and/or stopping tabs 50. However, in other examples, the mounting bracket 14 need not be symmetrical. As one non-limiting example, one side of the mounting bracket 14 includes extensions 48 and/or stopping tabs 50 while the other side does not. The mounting bracket 14 is symmetrical in the illustrated embodiments; however, such need not be the case in all embodiments.

Figure 18:
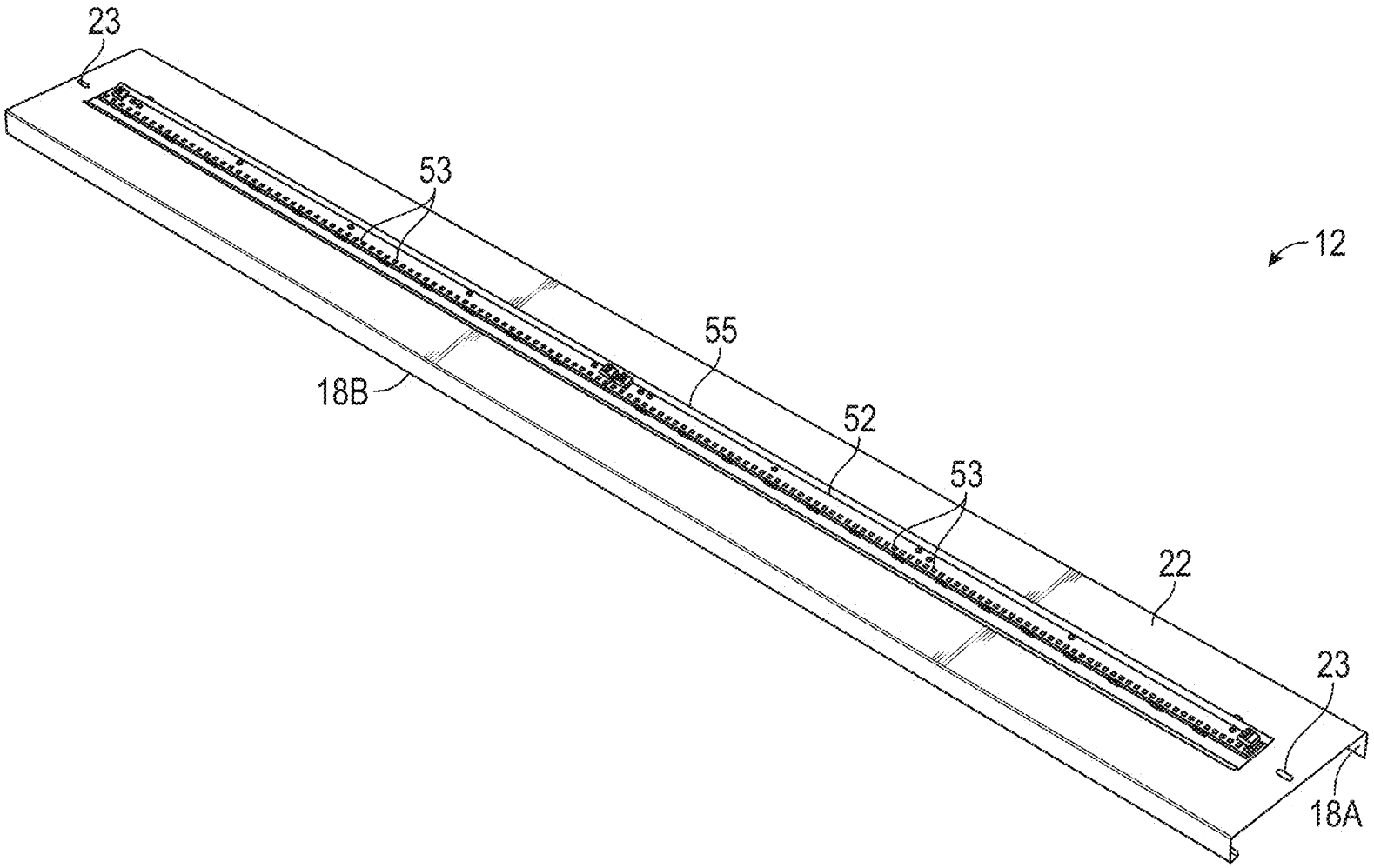
FIG. 18 is a perspective view of a light engine base of a light engine for retrofitting an existing light fixture according to examples of the present invention.
Figure 19:
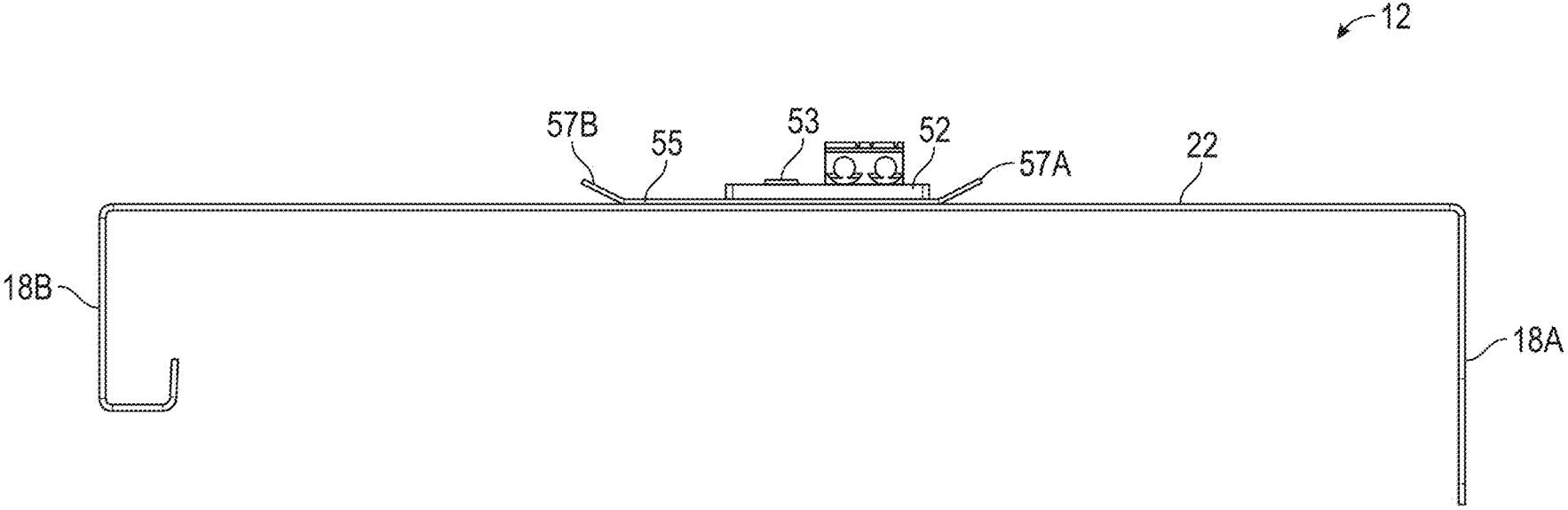
FIG. 19 is an end view of the light engine base of FIG. 18.

As shown in FIG. 1, some embodiments of the retrofit kit also include a lens 16. The lens 16 is positioned over the LEDs on the light-emitting side 24 of the light engine 12, and may serve both as an aesthetic cover and to functionally direct or diffuse light to provide better lighting conditions. The lens 16 may be of any type (diffuse, prismatic, etc.) and any shape that achieves the desired light distribution from the light fixture 21. In various examples, the lens 16 may be mounted on the light engine 12 through mechanical fasteners (such as screws, self-tapping screws, pins, bolts, rivets, or other mechanical fastening devices), a snap-fit arrangement, or various other suitable fastening mechanisms. As illustrated in FIGS. 18 and 19, in some optional examples, light engine 12 includes the PCB 52 attached to a separate lens retention component 55 that is connected to the light engine base 22. In such a case, the lens 16 may attach to flanges 57A-B of the component 55 (rather than directly to the light engine base 22). Various other configurations of the light engine base 22, PCB 52, and lens 16 may be provided.

FIGS. 5-8 and 15-17 illustrate various stages of installation of the light engine 12 into the existing light fixture 21. Prior to installation, the existing light fixture 21 is stripped of its existing light elements and their associated wiring and electronics. The method of stripping the existing light fixture 21 will vary depending upon the particular type of light elements, their associated hardware and electrical connections, and the configuration of the existing light fixture 21. Generally, the process for removal of the lighting elements from an existing light fixture 21 will include: (i) removing electrical power from the existing light fixture 21; (ii) disconnecting any lighting elements and associated hardware from the existing light fixture 21; and (iii) removing unnecessary brackets or hardware, if any. The existing light fixture 21 is then in a bare condition and ready for the installation of the light engine 12.

After the existing light fixture 21 has been stripped, the mounting brackets 14 may be installed into the housing 20 of the existing light fixture 21 by positioning edges of the housing 20 within the channel-centering slots 36 of the mounting brackets 14. The fasteners 44 (e.g., self-tapping screws, bolts, pins, rivets, etc.) are installed through the mounting flanges 42A-B to secure the mounting brackets 14 relative to the housing 20.

Figure 5:
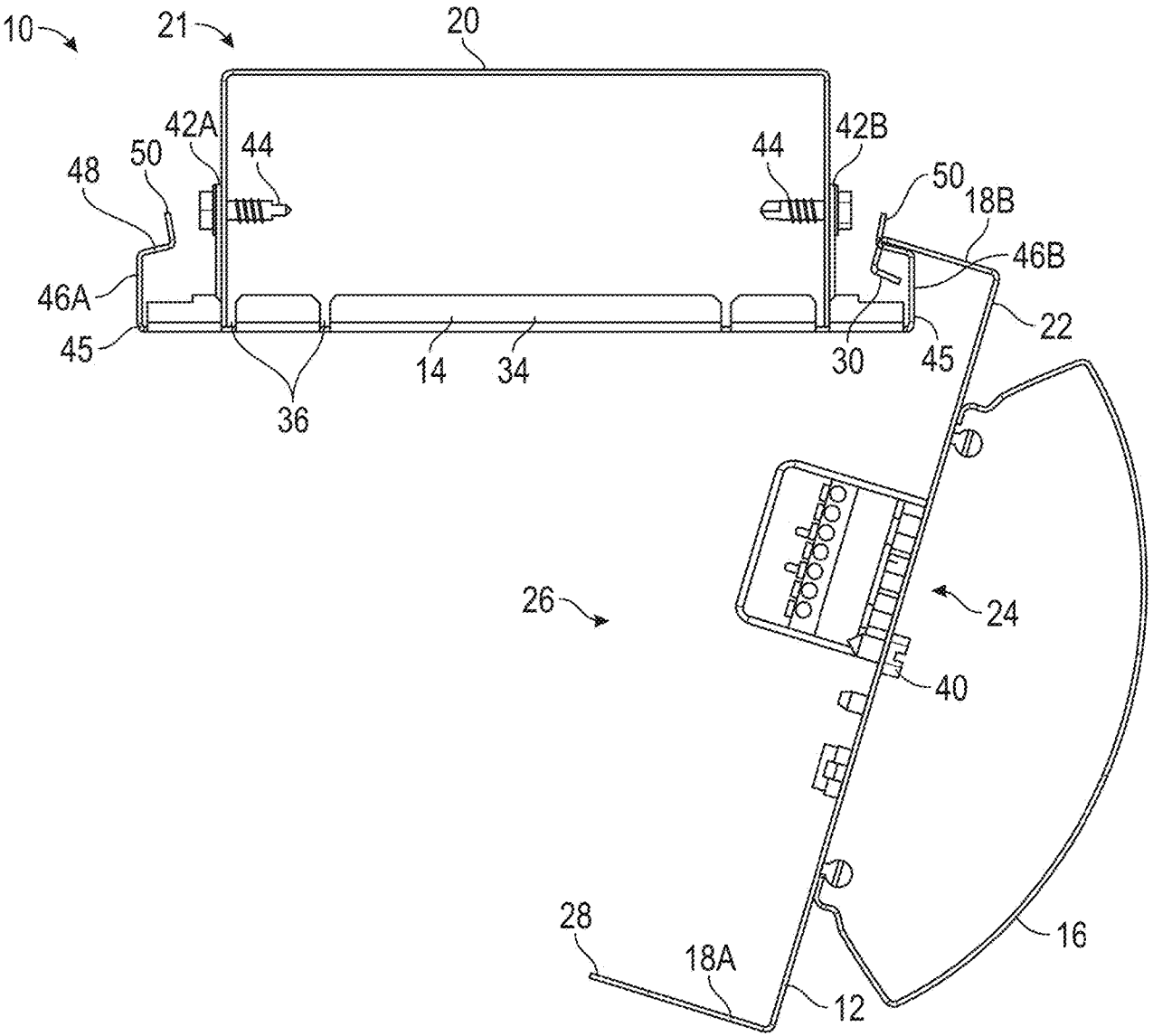
FIG. 5 is an end view of the light engine of FIG. 1 in a temporary hanging position.
Figure 6:
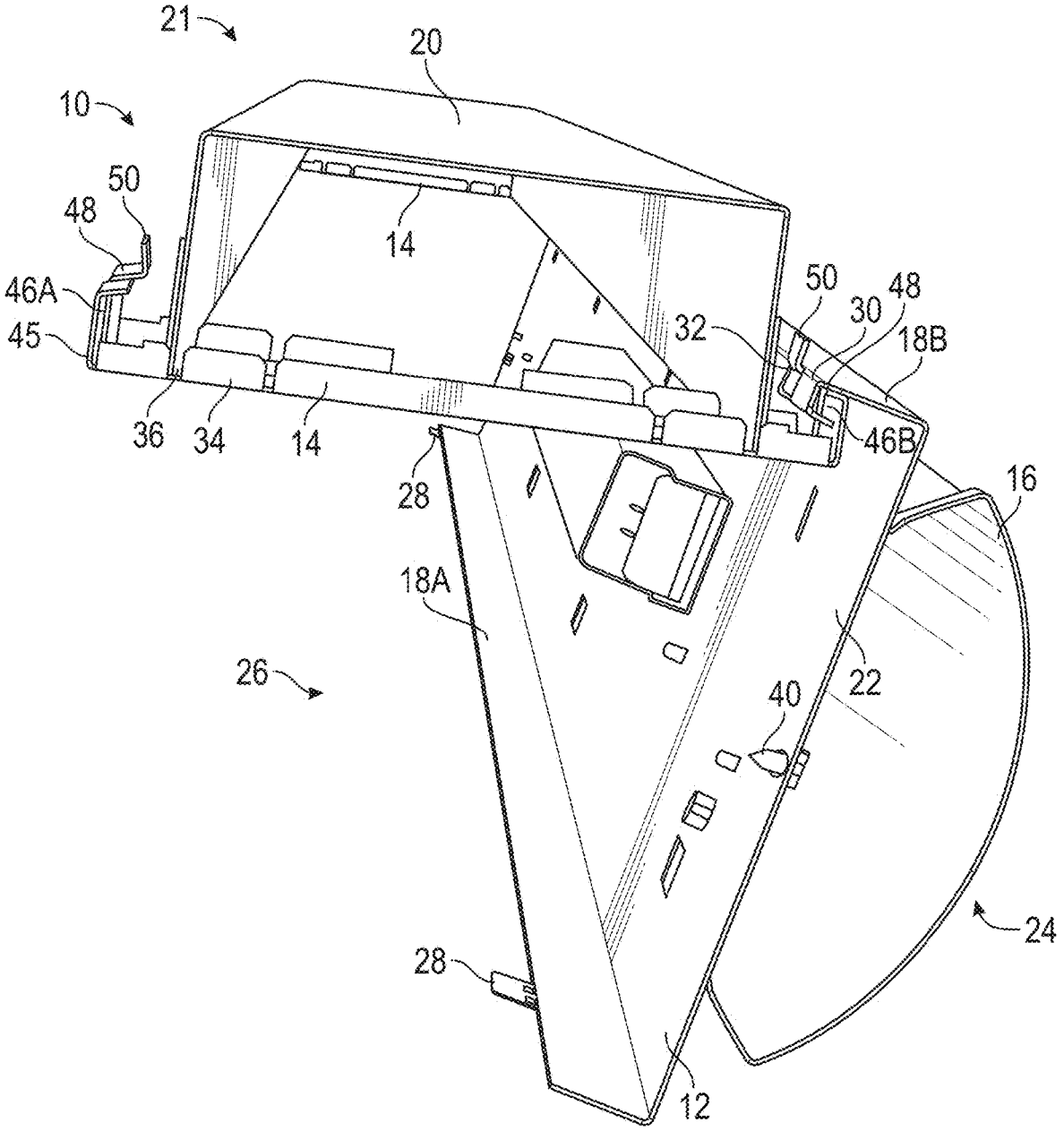
FIG. 6 is a perspective view of the temporary hanging position of FIG. 5.

Once the mounting brackets 14 are installed in the housing 20, the light engine 12 may be placed in a temporary hanging position (see FIGS. 5 and 6). In the temporary hanging position, the hooks 30 of the engine flange 18B of the light engine 12 wrap around bracket flanges 46B. When so positioned, the hooks 30 rest upon the extensions 48 of the bracket flange 46B and the stopping tab 50 of each bracket flange 46B is positioned within the notch 32 defined by the hooks 30. Engagement of the hooks 30 with the bracket flanges 46B creates a hinge that supports the light engine 12 in the temporary hanging position, and the light engine 12 may freely hang from the mounting brackets 14 without any additional support. Positioning of the stopping tabs 50 within the notches 32 prevents relative sliding between the light engine 12 and mounting brackets 14 (and thus also the light fixture 21). The positioning of the hooks 30 on the extensions 48 of the mounting bracket 14 prevents the light engine 12 from being disengaged from the mounting bracket 14.

In the temporary hanging position, the engine flange 18A is spaced apart from the bracket flange 46A such that an installer may access the non-light-emitting side 26 and/or within the housing 20. In various examples, the installer may position the light engine 12 in the temporary hanging position while electrical connections are made on the light engine 12 and/or within the housing 20.

Figure 7:
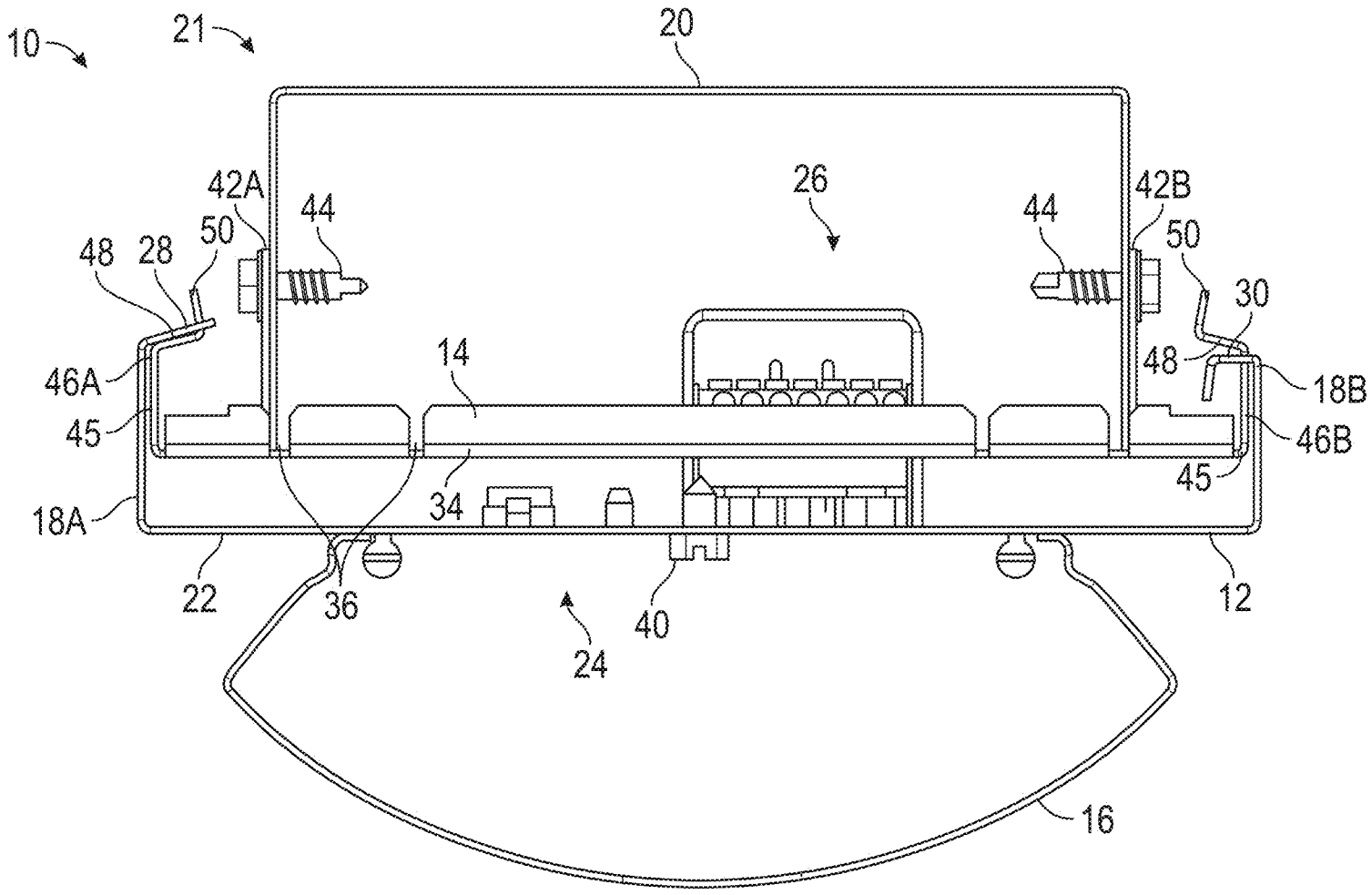
FIG. 7 is an end view of the light engine of FIG. 1 in a temporary support position.

After the electrical connections are made, the light engine 12 is rotated or pivoted about the hinge formed between the hooks 30 and the bracket flanges 46B and into the temporary support position (see FIG. 7). In the temporary support position, the light engine 12 is supported by the mounting bracket 14 but is not mechanically secured to the mounting bracket 14. As illustrated in FIG. 7, in the temporary support position, the engine flange 18A is adjacent to the bracket flange 46A, and the convenience tabs 28 are bent (e.g., by the installer manually or with a tool) such that the convenience tabs 28 overlap portions of the extensions 48 of the bracket flange 46A. In some examples, the convenience tabs 28 may abut extensions 48 of the bracket flange 46A, although they need not. As illustrated in FIG. 7, in the temporary support position, the captive screw 40 is engaged in the captive screw aperture 23 in the light engine base 22 but is not yet engaged with the captive screw aperture 38 of the mounting bracket 14. In some examples, in the temporary support position, the light engine base 22 is spaced apart from the base 34 of the mounting bracket 14 such that a gap is between the light engine 12 and the mounting bracket 14.

Figure 8:
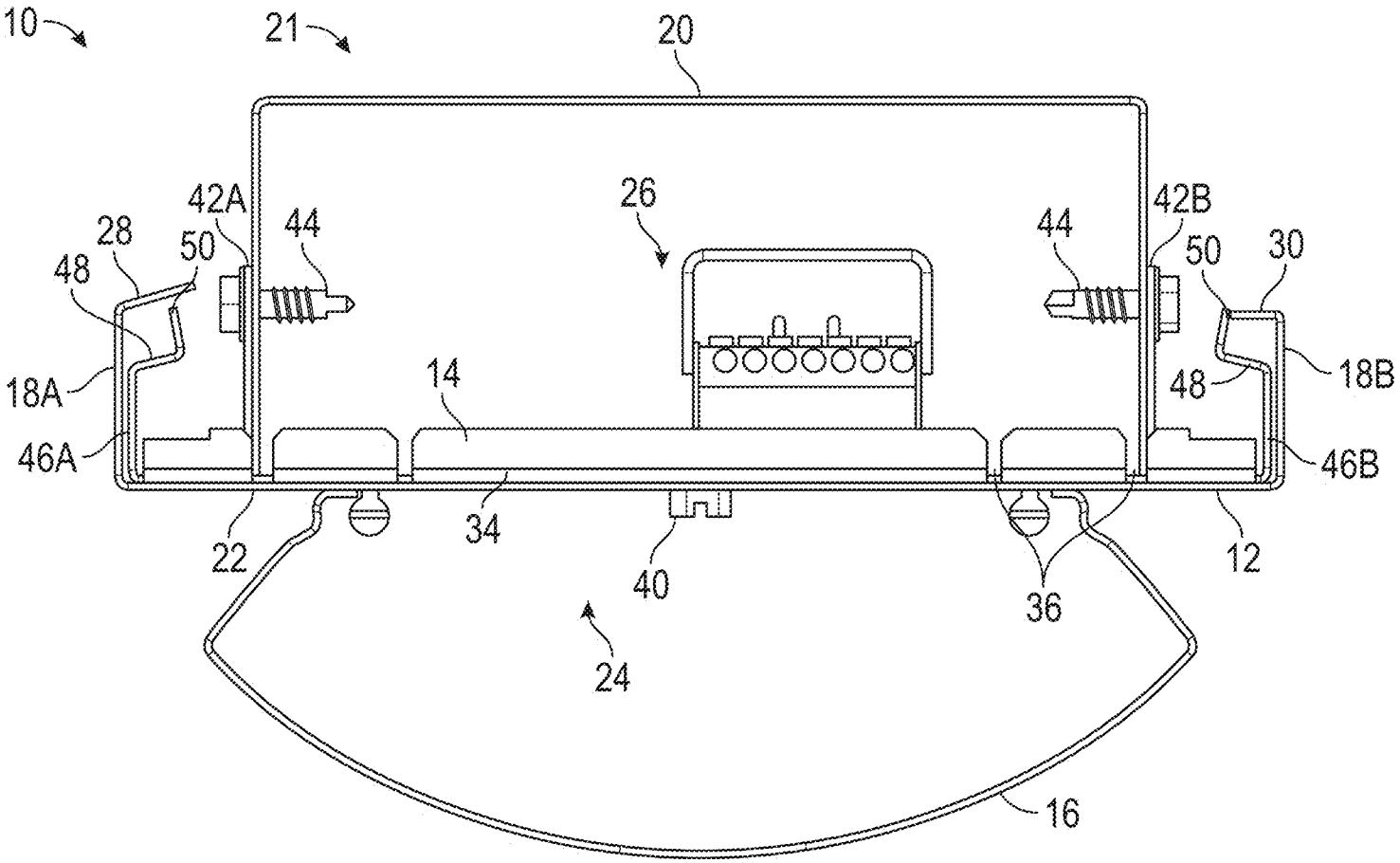
FIG. 8 is an end view of the light engine of FIG. 1 in an installed position.

As illustrated in FIG. 8, to fully install the light engine 12, the installer engages the captive screw 40 with the captive screw aperture 38 such that, upon further tightening of the captive screw 40, the light engine base 22 is drawn towards to the base 34. In some cases, the light engine base 22 abuts the base 34 in the fully-installed position, although it need not. Compared to the temporary support position, in the fully-installed position, the light engine 12 is mechanically secured to the mounting bracket 14 (e.g., through the captive screw 40).

Optionally, in some examples, the engine flanges 18A-B are dimensioned such that when the light engine 12 is in the fully-installed position, the engine flanges 18A-B overlap or substantially overlap the bracket flanges 46A-B. By overlapping the bracket flanges 46A-B, the engine flanges 18A-B hides or substantially hides the bracket flanges 46A-B from view when viewed from the light-emitting side 24.

Referring to FIGS. 9-14, another example of a retrofit kit 100 is illustrated. Similar to the retrofit kit 10, the retrofit kit 100 includes a light engine 112, a bracket 114, and the lens 16.

Figure 10:
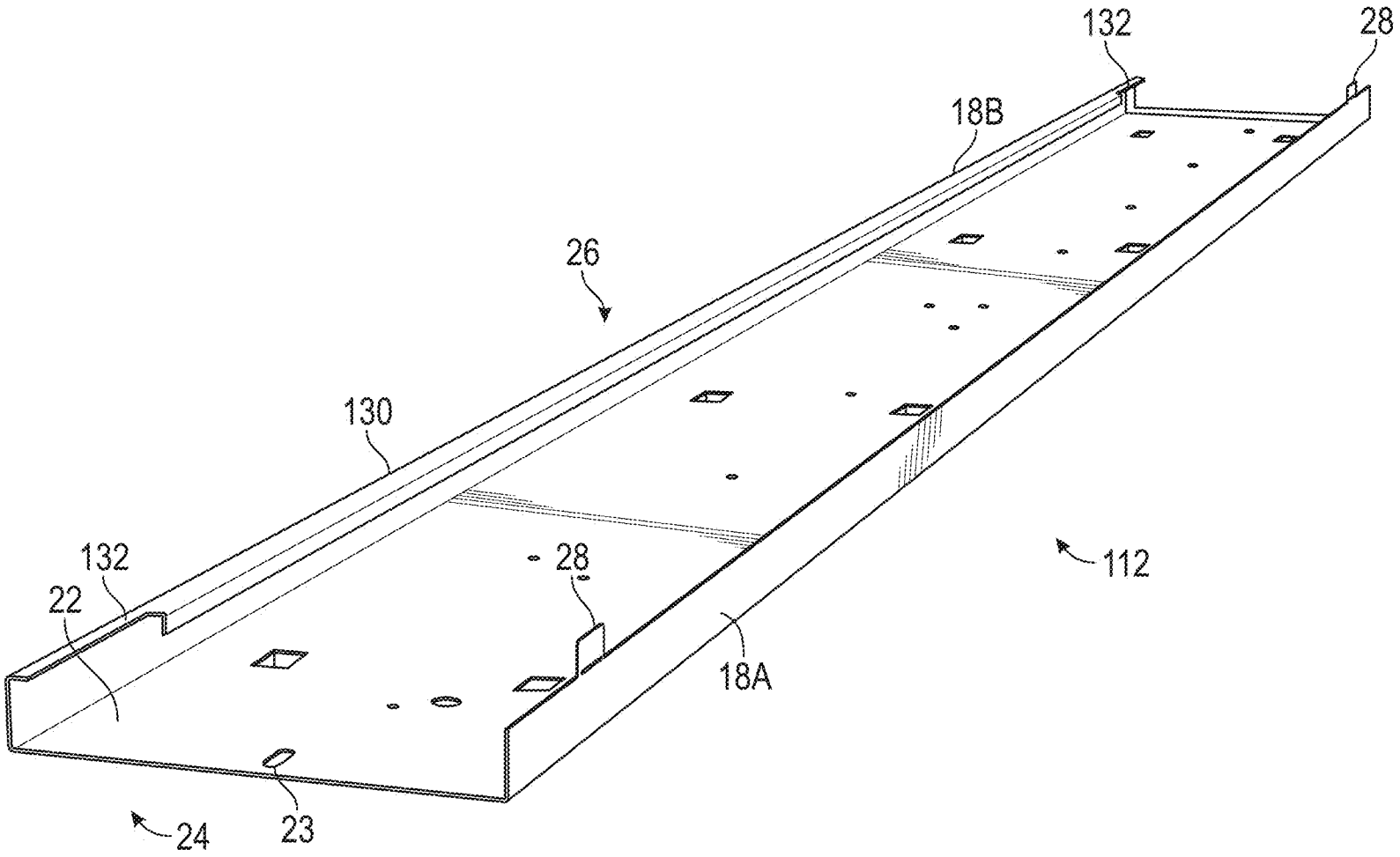
FIG. 10 is a perspective view of the light engine base of FIG. 9.
Figure 11:
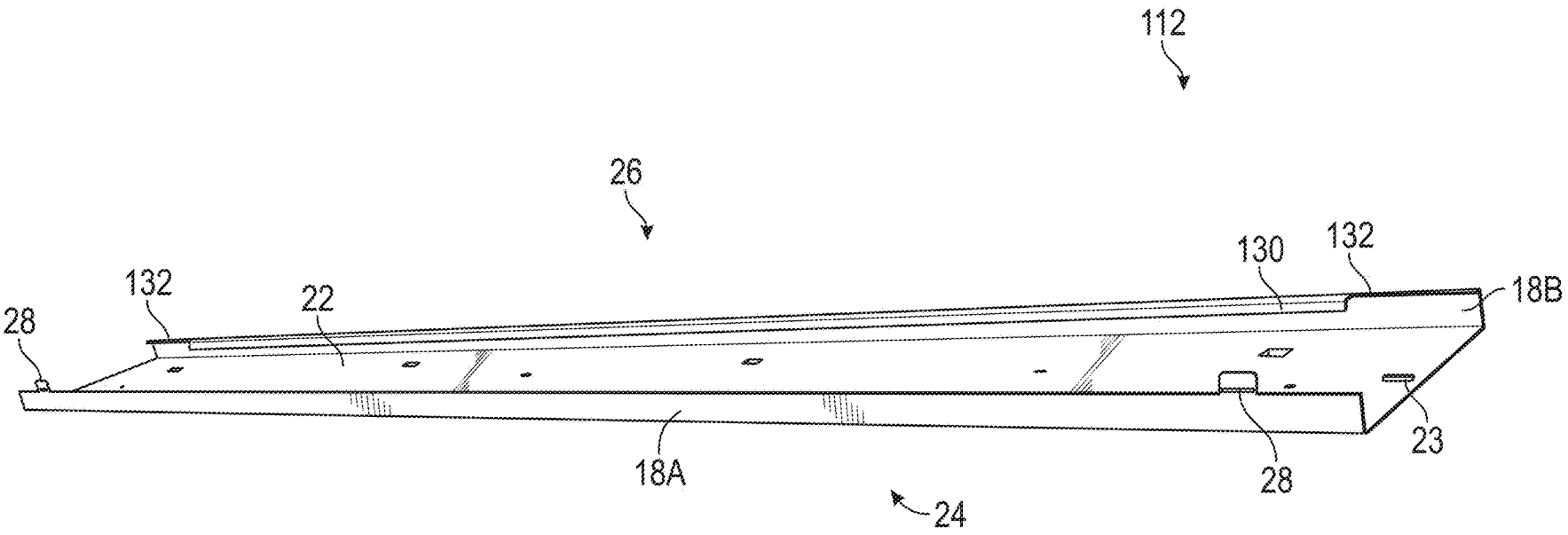
FIG. 11 is another perspective view of the light engine base of FIG. 9.
Figure 12:
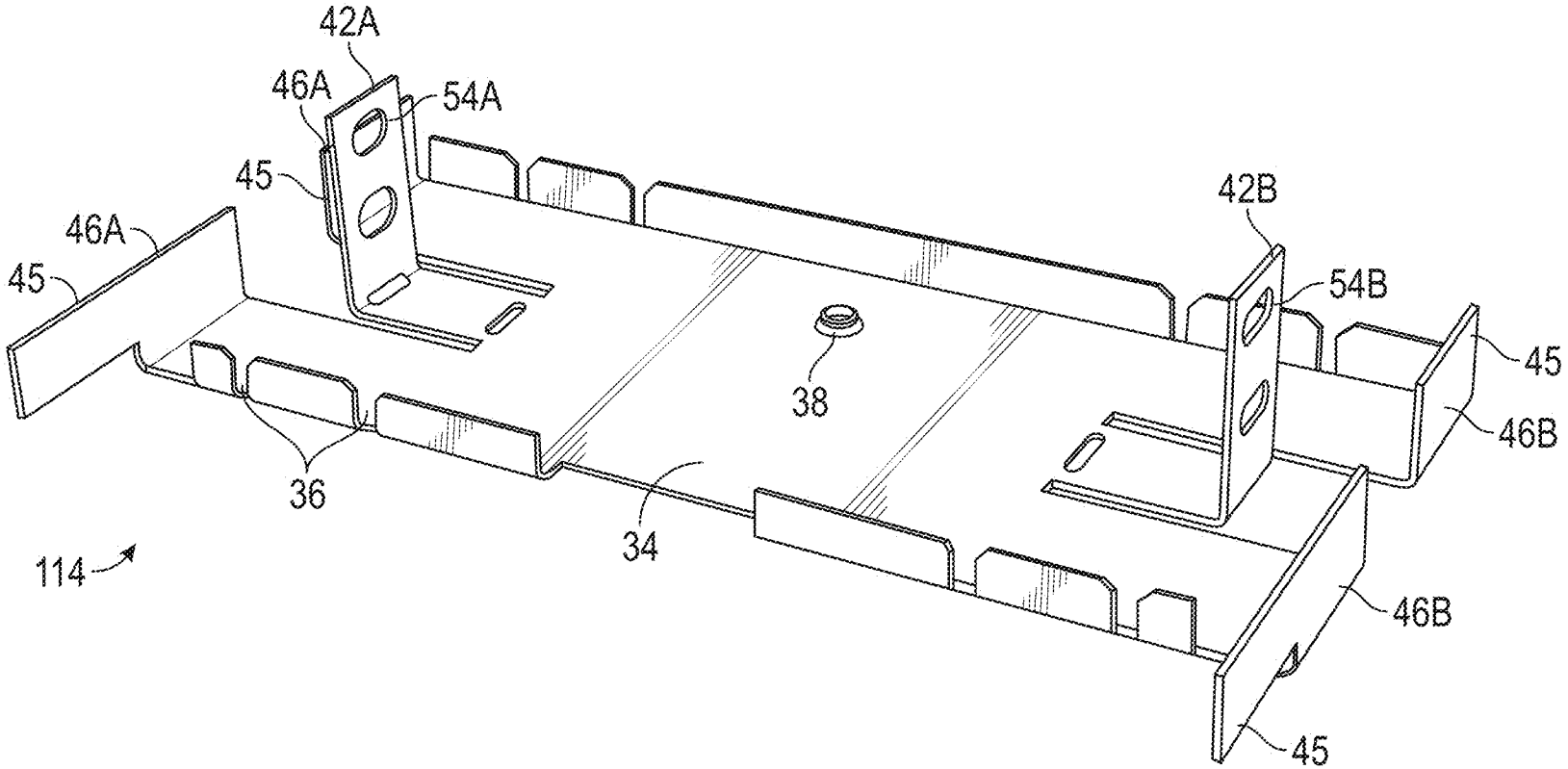
FIG. 12 is a perspective view of a mounting bracket of the mounting system of FIG. 9.

The light engine 112 is similar to the light engine 12 except that the engine flange 18B includes a single, continuous hook 130 extending along a length of the light engine 112 (see FIGS. 10 and 11). The continuous hook 130 defines notched hook portions 132 for receiving portions of the mounting bracket 114 to limit sliding movement of the light engine 112 relative to the mounting brackets 114 and light fixture 21.

The mounting bracket 114 is similar to the mounting bracket 14 except that the mounting bracket 114 does not include the extensions 48 and stopping tabs 50 that extend from the upstanding arms 45.

Figure 9:
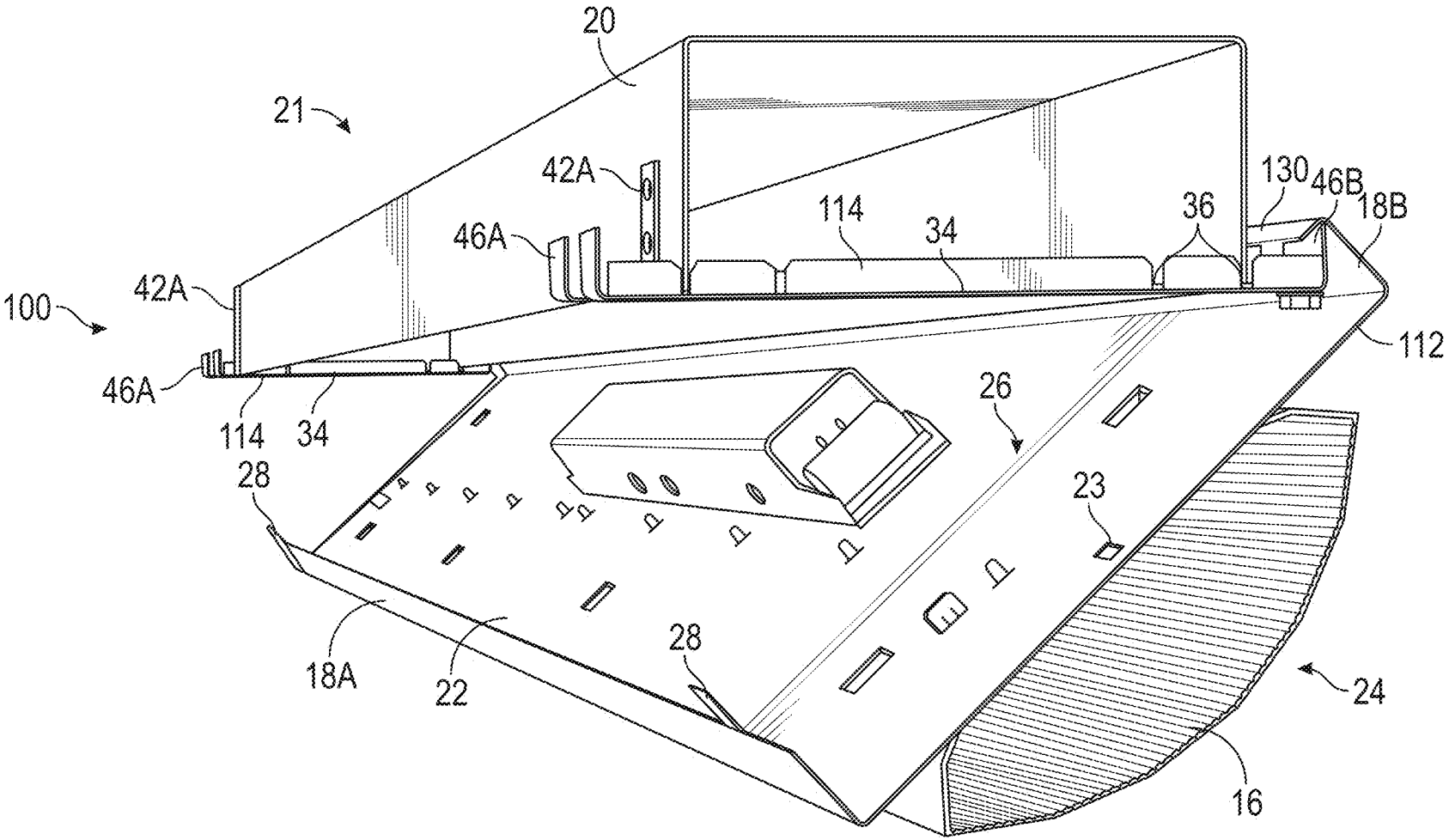
FIG. 9 is a perspective view of a light engine with a mounting system for retrofitting an existing light fixture according to examples of the present invention.
Figure 13:
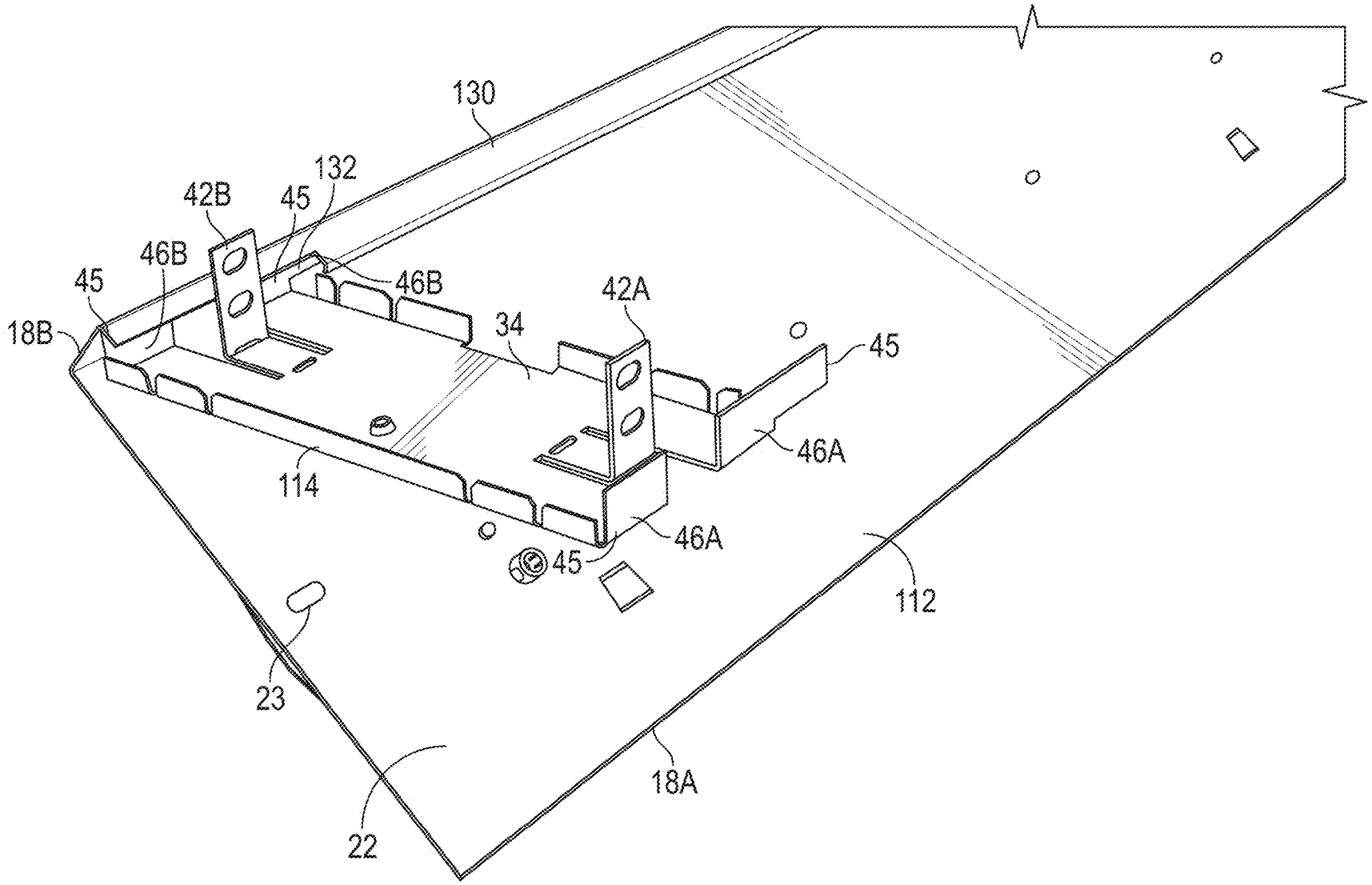
FIG. 13 is a perspective view of the light engine of FIG. 9 in a temporary hanging position.
Figure 14:
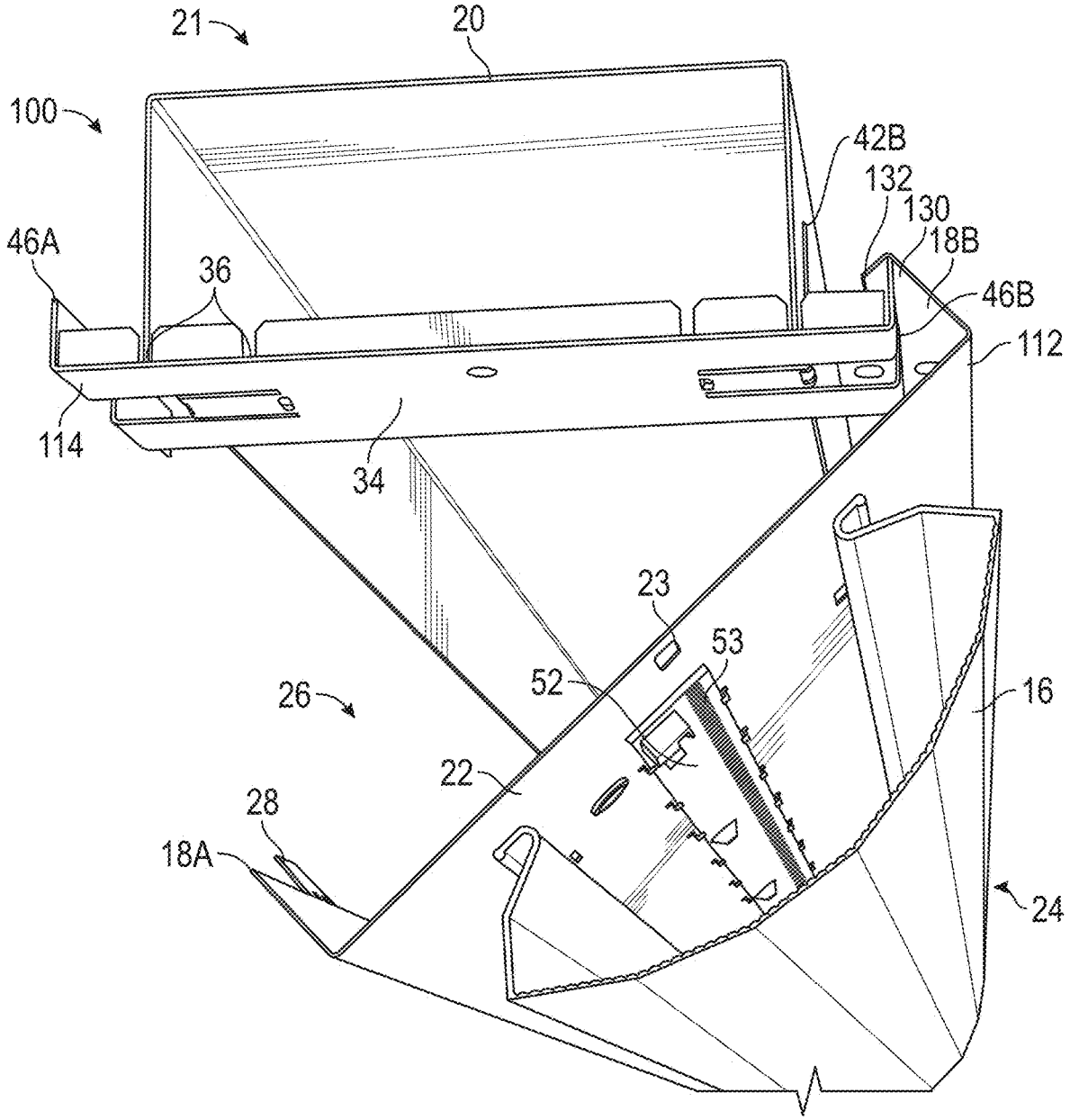
FIG. 14 is another perspective view of the light engine of FIG. 9 in the temporary hanging position.
Figure 15:
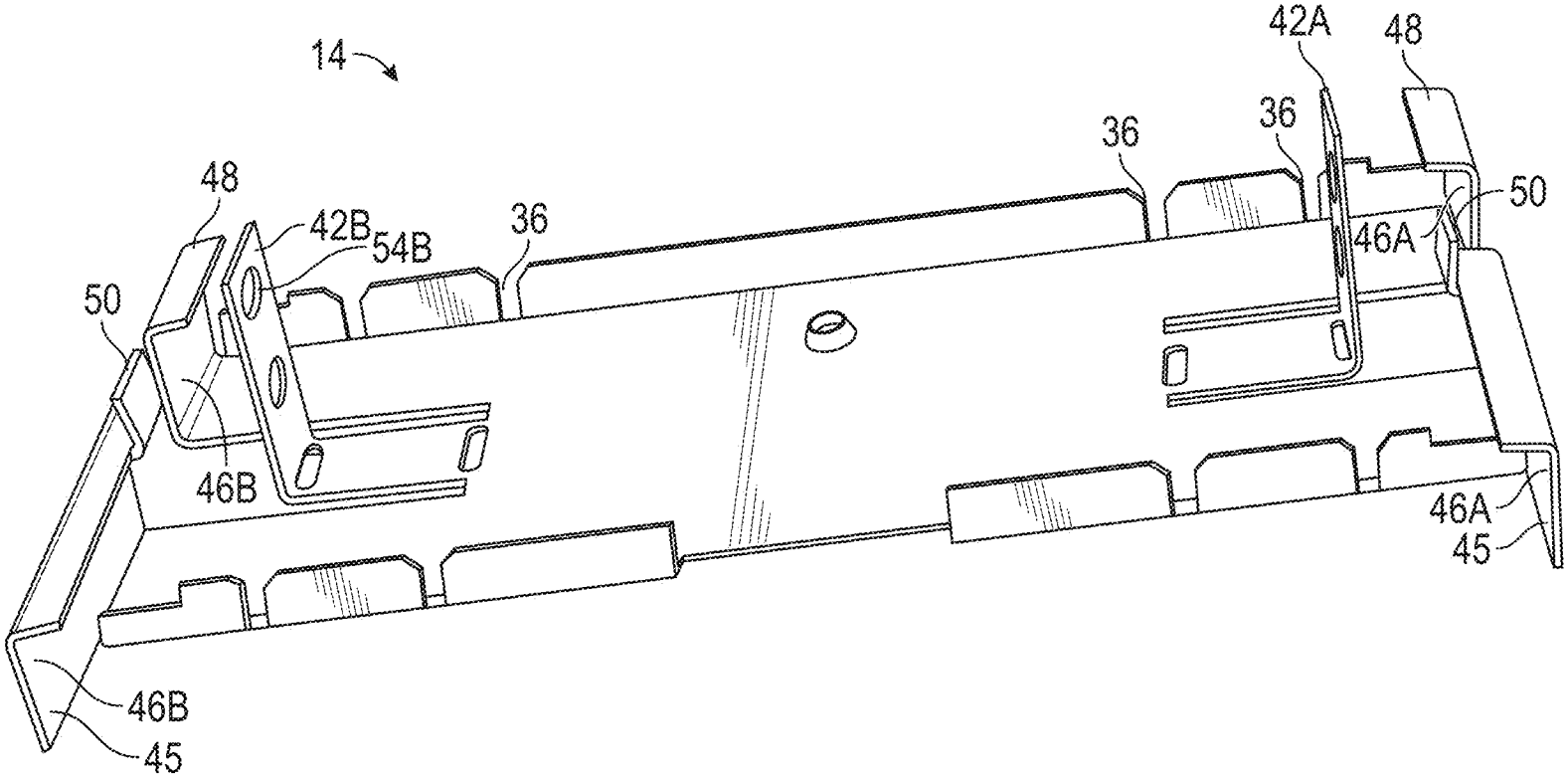
FIG. 15 is another perspective view of the mounting bracket of FIG. 4.
Figure 16:
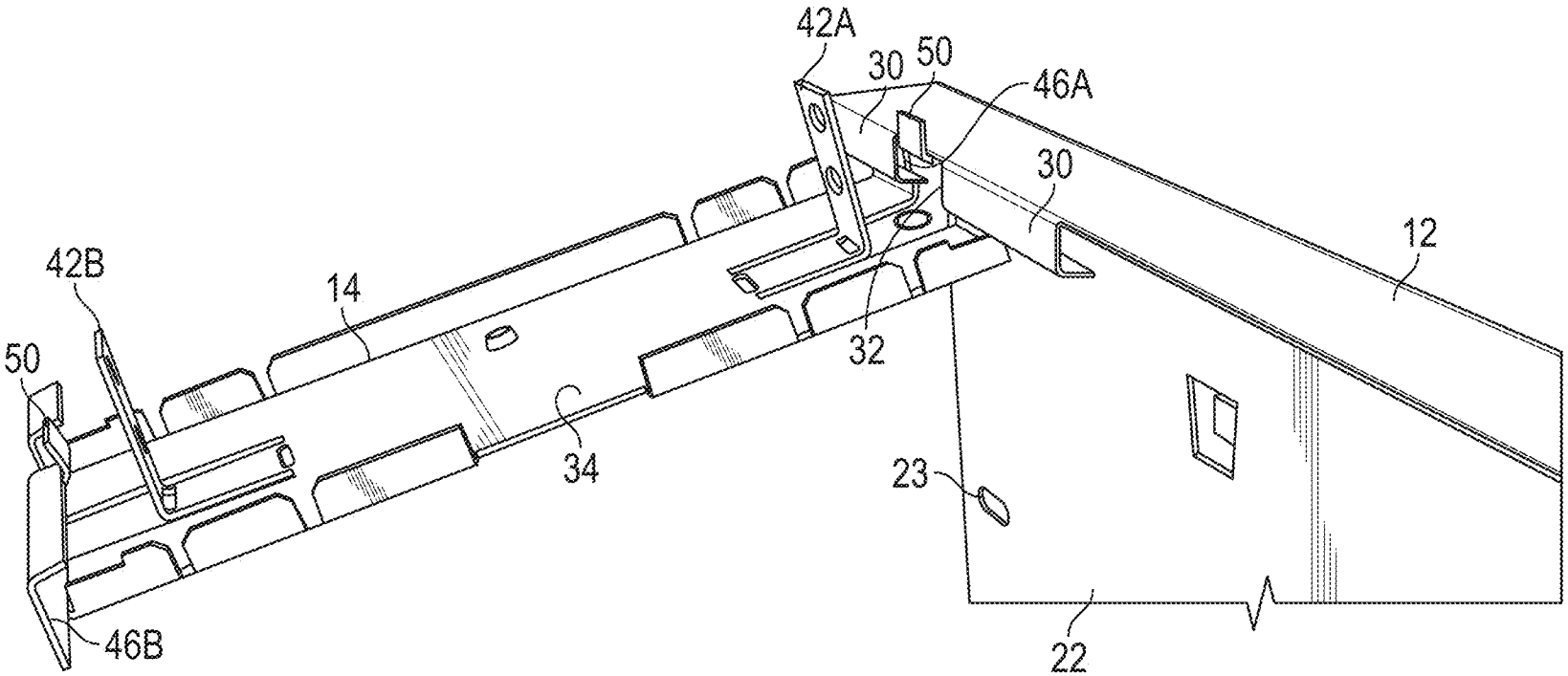
FIG. 16 is an enlarged view of the mounting bracket of FIG. 4 supporting the light engine of FIG. 2 in a temporary hanging position.
Figure 17:
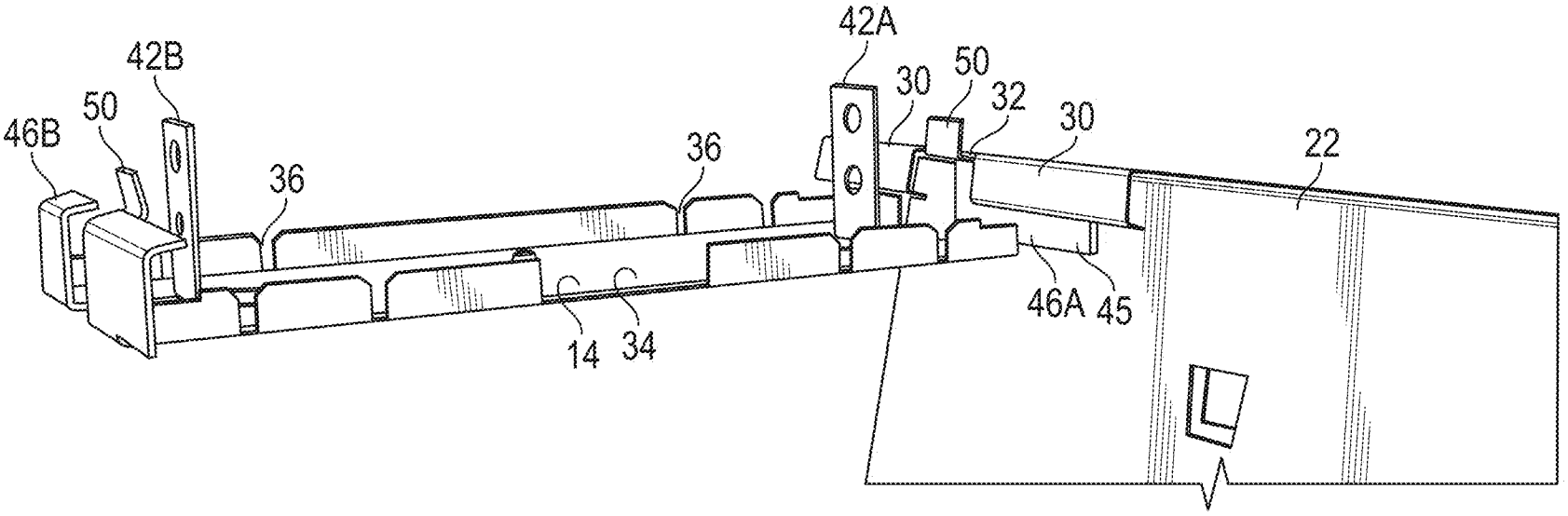
FIG. 17 is another enlarged view of mounting bracket of FIG. 4 supporting the light engine of FIG. 2 in a temporary hanging position.

As illustrated in FIGS. 9, 13, and 14, during installation of the light engine 112, in the temporary hanging position, the notched hook portions 132 wrap around the upstanding arms 45 of the bracket flanges 46A-B such that the light engine 112 may freely hang from the mounting bracket 114 without any additional support. Portions of the upstanding arms 45 are positioned behind the hook 130 to further aid in supporting the light engine 112 in the temporary hanging position. In some examples, a combination of the base 34 and the upstanding arms 45 may limit longitudinal movement or maintain the longitudinal position of the light engine 12 relative to the light fixture 21 in at least one direction because the base 34 will interfere with the longitudinal movement of the hook 130. Such engagement may prevent the light engine 112 from disengaging from the mounting bracket 114 and releasing the light engine 112.

In the temporary support position, the convenience tabs 28 are bent such that the convenience tabs 28 overlap portions of the upstanding arms 45 of the bracket flanges 46A. In some examples, the convenience tabs 28 optionally wrap around bracket flanges 46A, although they need not.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

That which is claimed:

1. A retrofit kit for a light fixture comprising:

a light engine comprising a base, a first engine flange at a first side of the base, and a second engine flange at a second side of the base opposite the first side; and a mounting bracket, wherein the first engine flange comprises a foldable convenience tab and the second engine flange comprises a hook, wherein the foldable convenience tab is foldable relative to the first engine flange, and wherein the hook is configured to engage the mounting bracket such that the light engine is pivotally supported on the mounting bracket.

2. The retrofit kit of claim 1, wherein the light engine is movable relative to the mounting bracket between a temporary hanging position, a temporary support position, and a fully-installed position, wherein:

in the temporary hanging position, the hook is engaged with the mounting bracket and the first engine flange is spaced apart from the mounting bracket;

in the temporary support position, the hook is engaged with the mounting bracket, the foldable convenience tab is engaged with the mounting bracket, and the base of the light engine is spaced apart from a base of the mounting bracket; and in the fully-installed position, the base of the light engine abuts the base of the mounting bracket.

3. The retrofit kit of claim 2, wherein the mounting bracket comprises a bracket base, a first bracket flange at a first side of the bracket base, and a second bracket flange at a second side of the bracket base opposite the first side, and wherein, in the fully-installed position, the first engine flange conceals the first bracket flange and the second engine flange conceals the second bracket flange.

4. The retrofit kit of claim 3, wherein the mounting bracket further comprises a first mounting flange and a second mounting flange configured to support the mounting bracket on a housing of a light fixture.

5. The retrofit kit of claim 1, wherein the mounting bracket comprises a first bracket flange and a second bracket flange, wherein the hook is configured to engage the second bracket flange, and wherein the foldable convenience tab is configured to engage the first bracket flange in a temporary support position such that the light engine is supported by the mounting bracket.

6. The retrofit kit of claim 5, wherein the hook comprises a notch, and wherein the second bracket flange comprises a stopping tab that is configured to engage the notch in the temporary support position.

7. The retrofit kit of claim 1, wherein the light engine further comprises a plurality of light emitting diodes.

8. A method of installing a retrofit kit in a light fixture comprising:

installing a mounting bracket onto a housing of the light fixture; and placing a light engine in a temporary hanging position, wherein, in the temporary hanging position, a hook of a first engine flange of the light engine rests on the mounting bracket and a foldable convenience tab of a second engine flange of the light engine is spaced apart from the mounting bracket, wherein the foldable convenience tab is foldable relative to the second engine flange.

9. The method of claim 8, further comprising:

pivoting the light engine relative to the mounting bracket such that the light engine is in a temporary support position, wherein, in the temporary support position, the hook is engaged with the mounting bracket, the foldable convenience tab is engaged with the mounting bracket, and the light engine is vertically movable relative to the mounting bracket.

10. The method of claim 9, wherein, in the temporary support position, the hook is engaged with a first bracket flange of the mounting bracket and the foldable convenience tab is bent and engaged with a second bracket flange of the mounting bracket.

11. The method of claim 9, wherein, in the temporary support position, a light engine base of the light engine is spaced apart from a bracket base of the mounting bracket such that a gap is between the light engine and the mounting bracket.

12. The method of claim 9, further comprising:

positioning the light engine in a fully-installed position by securing the light engine to the mounting bracket.

13. The method of claim 12, wherein, in the fully-installed position, a light engine base of the light engine abuts a bracket base of the mounting bracket.

14. The method of claim 8, wherein placing the light engine in the temporary hanging position comprises positioning a stopping tab of a first bracket flange of the mounting bracket in a notch defined by the hook.

15. A retrofit kit for a light fixture comprising:

a light engine; and a mounting bracket comprising a pair of bracket flanges at opposing sides of a bracket base and a pair of mounting flanges between the bracket flanges, wherein a distance between the mounting flanges is less than a distance between the bracket flanges, wherein the light engine is supportable on the bracket flanges in a temporary support position, and wherein the mounting flanges are configured to engage a housing of the light fixture such that the mounting bracket is supported on the housing.

16. The retrofit kit of claim 15, wherein the light engine comprises a pair of engine flanges, wherein a first engine flange of the pair of engine flanges comprises a hook and a second engine flange of the pair of engine flanges comprises a foldable convenience tab, and wherein, in the temporary support position, the hook is engaged with a first bracket flange of the pair of bracket flanges and the foldable convenience tab is engaged with a second bracket flange of the pair of bracket flanges.

17. The retrofit kit of claim 16, wherein the light engine is movable relative to the mounting bracket between a temporary hanging position, the temporary support position, and a fully-installed position, wherein:

in the temporary hanging position, the hook is engaged with the first bracket flange of the mounting bracket and the second engine flange is spaced apart from the second bracket flange;

in the temporary support position, a base of the light engine is spaced apart from the base of the mounting bracket; and in the fully-installed position, the base of the light engine abuts the base of the mounting bracket.

18. The retrofit kit of claim 15, wherein the mounting bracket further comprises channel-centering slots configured to receive portions of the housing of the light fixture during installation to position the mounting bracket relative to the housing.

19. The retrofit kit of claim 15, further comprising a plurality of light emitting diodes on a light-emitting side of the light engine and a lens secured to the light-emitting side of the light engine below the plurality of light emitting diodes.

20. The retrofit kit of claim 15, wherein the mounting flanges are bendable relative to the bracket base such that the distance between the mounting flanges is adjustable.

* * * * *